US011363872B1

(12) United States Patent
Lydiard

(10) Patent No.: US 11,363,872 B1
(45) Date of Patent: Jun. 21, 2022

(54) SHAVING BRUSH WITH INTERCHANGEABLE BRISTLES

(71) Applicant: John B. Lydiard, Sarasota, FL (US)

(72) Inventor: John B. Lydiard, Sarasota, FL (US)

( * ) Notice: Subject to any disclaimer, the term of this patent is extended or adjusted under 35 U.S.C. 154(b) by 278 days.

(21) Appl. No.: 15/931,639

(22) Filed: May 14, 2020

Related U.S. Application Data

(60) Provisional application No. 62/921,242, filed on Jun. 5, 2019, provisional application No. 62/922,432, filed on Aug. 9, 2019.

(51) Int. Cl.

| | |
|---|---|
| ***A45D 27/04*** | (2006.01) |
| ***A46B 5/02*** | (2006.01) |
| ***A46B 9/10*** | (2006.01) |
| ***A46B 7/04*** | (2006.01) |
| ***A46B 5/00*** | (2006.01) |
| ***A46B 15/00*** | (2006.01) |

(52) U.S. Cl.
CPC ..... *A45D 27/04* (2013.01); *A46B 5/0095* (2013.01); *A46B 5/02* (2013.01); *A46B 7/04* (2013.01); *A46B 9/10* (2013.01); *A46B 15/0097* (2013.01); *A46B 2200/1033* (2013.01)

(58) Field of Classification Search
CPC ..... A45D 27/04; A46B 5/0095; A46B 5/02; A46B 7/02; A46B 7/04; A46B 9/10; A46B 2200/1033
See application file for complete search history.

(56) References Cited

U.S. PATENT DOCUMENTS

| | | | | | |
|---|---|---|---|---|---|
| 886,003 | A * | 4/1908 | Kraft | A01K 97/14 | 294/19.3 |
| 950,377 | A * | 2/1910 | Downey | A46B 15/00 | 15/194 |
| 1,353,984 | A * | 9/1920 | Behrman | A46B 5/0095 | 15/185 |
| 1,538,279 | A * | 5/1925 | Faucon | A46B 15/00 | 15/194 |
| 1,725,464 | A | 8/1929 | Lysons | | |
| 1,729,909 | A * | 10/1929 | Simmons | A46B 11/0093 | 15/248.1 |
| 2,516,778 | A | 7/1950 | Kreidenweiss | | |
| 2,584,881 | A * | 2/1952 | Johnson | A01K 97/14 | 294/19.3 |
| 2,748,414 | A * | 6/1956 | Glunt | A45D 44/00 | 15/176.1 |
| 2,752,625 | A * | 7/1956 | Ponsell | A47L 13/022 | 15/154 |
| 3,408,151 | A | 10/1968 | Plao | | |
| 3,833,252 | A * | 9/1974 | Redding | A01K 97/14 | 294/100 |
| 3,978,605 | A * | 9/1976 | Maruniak | A01K 97/14 | 294/115 |

(Continued)

FOREIGN PATENT DOCUMENTS

| | | |
|---|---|---|
| WO | WO 1997/08970 | 3/1997 |
| WO | WO 2018/224863 | 12/2018 |

*Primary Examiner* — Randall E Chin
(74) *Attorney, Agent, or Firm* — Livingston Law, P.A.; Edward M. Livingston, Esq.

(57) ABSTRACT

A shaving brush having interchangeable brush bristles employing fastening cuffs (9) with an internal adaption hoop (12) mounted in a housing (1) on a spring-mounted pedestal (13) openable by a push button (4) in a base (3).

5 Claims, 11 Drawing Sheets

(56) References Cited

U.S. PATENT DOCUMENTS

| | | | | |
|---|---|---|---|---|
| 4,172,610 | A * | 10/1979 | Johnson | F25C 5/043 294/115 |
| 5,435,037 | A | 7/1995 | Ledingham | |
| 6,321,408 | B1 | 11/2001 | Cleghorn | |
| 8,132,285 | B2 * | 3/2012 | Piao | A46B 7/04 15/176.1 |
| 8,794,249 | B2 | 8/2014 | Gerber et al. | |
| 9,730,510 | B1 * | 8/2017 | Arbos | A46B 7/042 |
| 2013/0014338 | A1 * | 1/2013 | Park | A46B 9/021 15/176.1 |

* cited by examiner

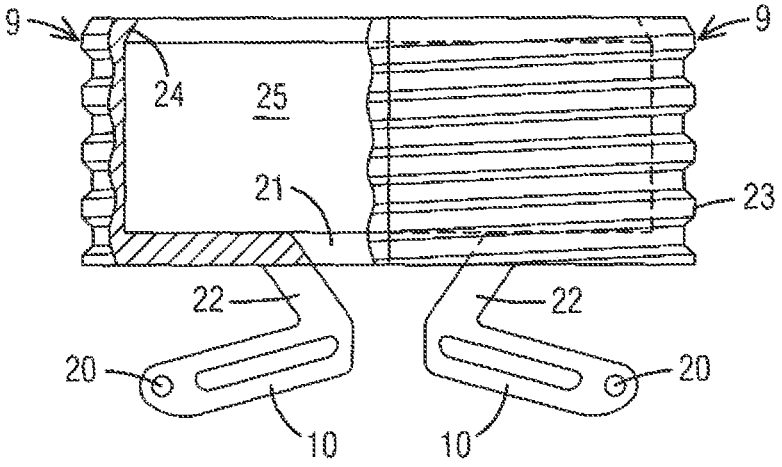
FIG. 4
FIG. 5
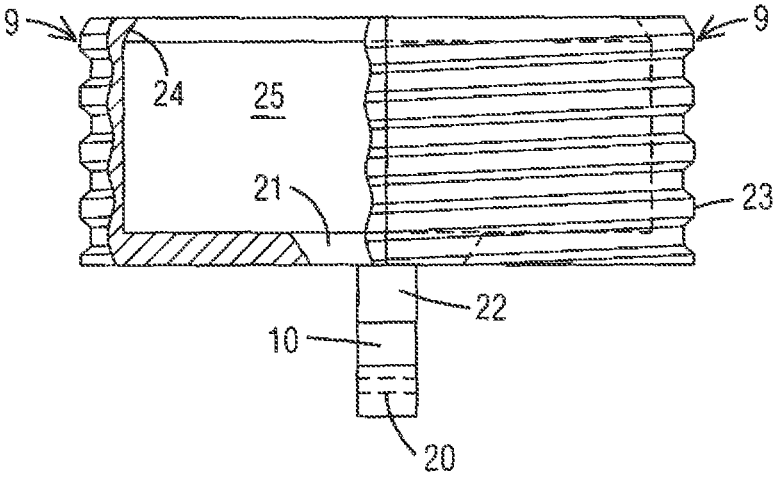
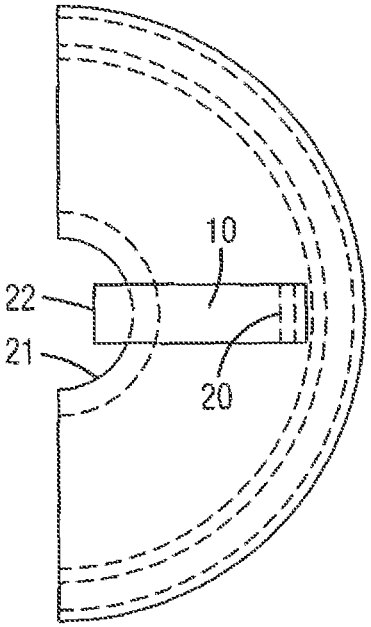
FIG. 6

SHAVING BRUSH WITH INTERCHANGEABLE BRISTLES

CROSS-REFERENCE TO RELATED APPLICATIONS

This application claims priority to provisional patent applications 62/921,242 filed on Jun. 5, 2019 and 62/922,432 filed on Aug. 9, 2019. The patent applications identified above are incorporated herein by reference in its entirety to provide continuity of disclosure.

FIELD OF THE INVENTION

This invention relates to shaving brushes and, more particularly, a shaving brush that allows a user to changes the bristles in the brush as desired, by the cartridgization of the shaving brush knots.

BACKGROUND OF THE INVENTION

The use of shaving brushes have become more popular in recent years due to a desire of users to obtain a better shave by the use of natural shaving creams and soaps rather than shaving creams from an aerosol can.

A problem with shaving brushes is that the bristles are permanently attached by glue or other adhesive, thus making it impossible to change to different bristles according to the desires of the user, thereby requiring one to purchase multiple brushes for different bristles.

Thus, a need exists for a shaving brush which will allow a user to change to different types of bristles, such as without limitation, synthetic, boar, badger, or bristle knot, by cartridgizing the shaving brush knot.

The relevant prior art includes the following references:

| Pat. No. (U.S. unless indicated otherwise) | Inventor | Issue/ Publication Date |
|---|---|---|
| 2,516,778 | Kreidenweiss | Jul. 25, 1950 |
| 1,725,464 | Lysons | Aug. 20, 1929 |
| 5,435,037 | Ledingham | Jul. 25, 1995 |
| WO97/08970 | Vasapolli | Mar. 17, 1997 |
| WO18/224863 | Biglia | Dec. 13, 2018 |
| 6,321,408 | Esterson et al. | Nov. 27, 2001 |
| 3,408,151 | Cleghorn | Oct. 29, 1968 |
| 8,132,285 | Piao | Mar. 13, 2012 |
| 8,794,249 | Gerber et al. | Aug. 5, 2014 |

SUMMARY OF THE INVENTION

The primary object of the present invention is to provide a shaving brush that allows a user to quickly and easily change to different types of bristles, such as without limitation, synthetic, boar or badger.

An additional object of the present invention is to provide a shaving brush that allows the user to employ different size bristle knots.

The present invention accomplishes the above and other objects by providing a shaving brush with interchangeable bristles having a base supporting a housing with a sleeve on a perimeter thereof for securely holding fastening cuffs. The fastening cuffs are attached to a base by two screws. The fastening cuffs are articulated by activation of a spring-mounted button at the base. Retractable guides on the fastening cuffs at a top of the housing retain the fastening cuffs. Push rods are connected to the release button, which extend to the fastening cuff guides, to open the fastening cuffs when the release button is activated. When deactivated, the release button is pushed outward by the central spring, thus allowing the fastening cuffs to be locked into closed position by the tension sleeve. An adaption hoop is located inside the fastening cuffs and is sized to fit and retain a shaving brush bristle knot.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 4 is a front partial cut-away view of the fastening cuffs of the shaving brush of the present invention;

FIG. 5 is a side view of one of the fastening cuffs of the shaving brush of the present invention;

FIG. 6 is a bottom view of one of the fastening cuffs of the shaving brush of the present invention;

DESCRIPTION OF THE PREFERRED EMBODIMENTS

Figure 1:
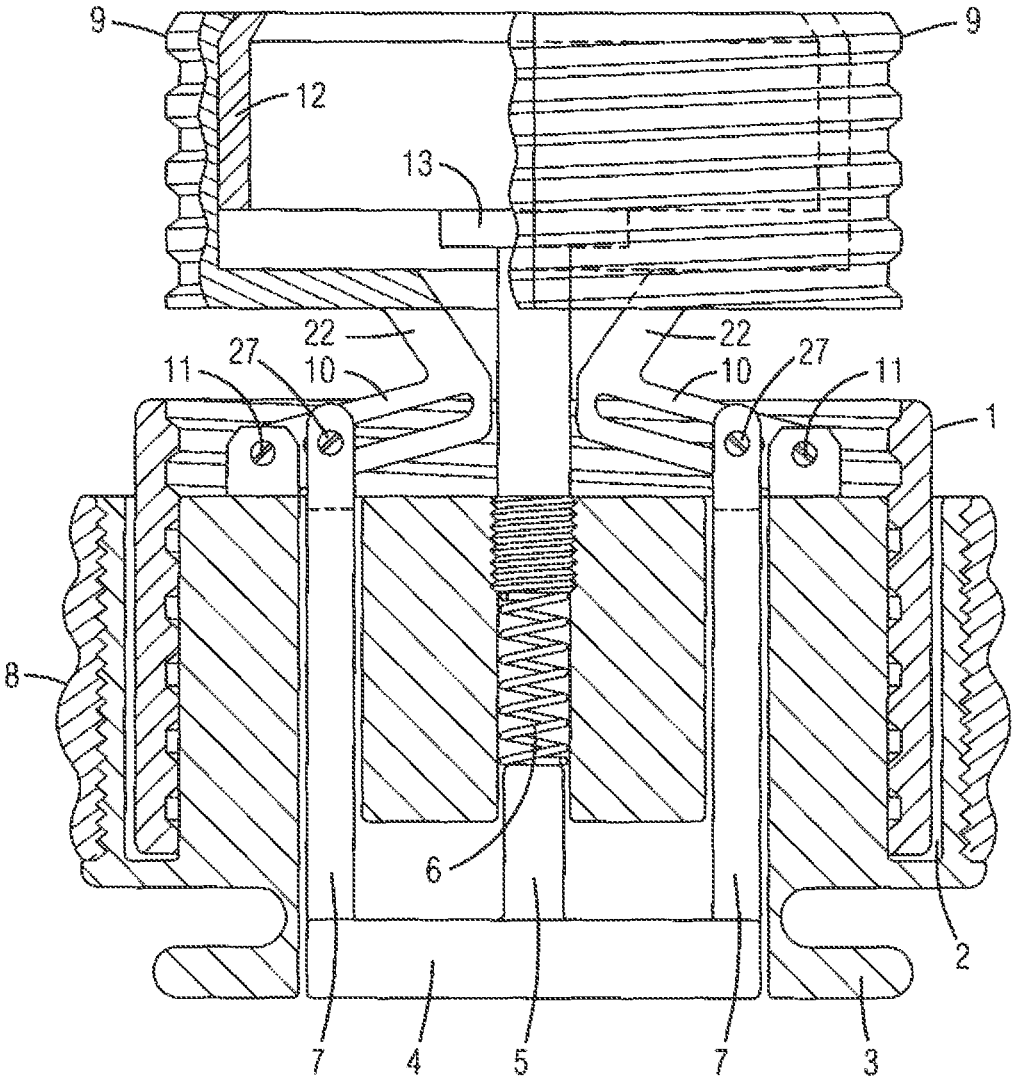
FIG. 1 is a side partial cut-away view of the shaving brush of the present invention.

For purposes of describing the preferred embodiment, the terminology used in reference to the numbered accessories in the drawings is as follows:

1. tension sleeve
2. tension sleeve housing
3. base
4. release button
5. central resistance rod
6. central spring
7. push rods
8. outer decorative ring
9. fastening cuffs
10. fastening cuff guides
11. fulcrum
12. adaption hoop
13. pedestal
14. threads for outer decorative ring
15. release button cavity
16. push rod cavity
17. central shaft
18. mounting anchor (unthreaded)
19. mounting anchor (threaded)
20. fulcrum holes
21. circular hole
22. fastening cuffs neck
23. fastening cuffs threading
24. fastening cuffs lip
25. interior space
26. brush bristle knot
27. push rod screws
28. n/a
29. outer diameter of adaption hoop
30. inner diameter of adaption hoop
31. inner threading
32. bristle Referring to FIG. 1 the tension sleeve 1 is shown in a disengaged position and housed in a tension sleeve housing 2, which is inside the base 3 of the shaving brush. A release button 4 pushes against a central spring 6, via a central resistance rod 5. When the tension sleeve 1 is disengaged, the release button 4 can be pushed to disengage the two fastening cuffs 9 via the two push rods 7, which articulate with fastening cuff guides 10. The upward motion of the release button 4 forces the opening of the fastening cuffs 9, as they pivot from a fulcrum 11, located on the top portion of the base 3 of shaving brush. This action will release the adaption hoop 12, which houses the shaving brush bristle knot (see 26 in FIG. 15) on the pedestal 13. An outer decorative ring 8 for gripping the shaving brush in a hand of a user can be any texture or any material and is illustrated here as having a wave design.

Figure 2:
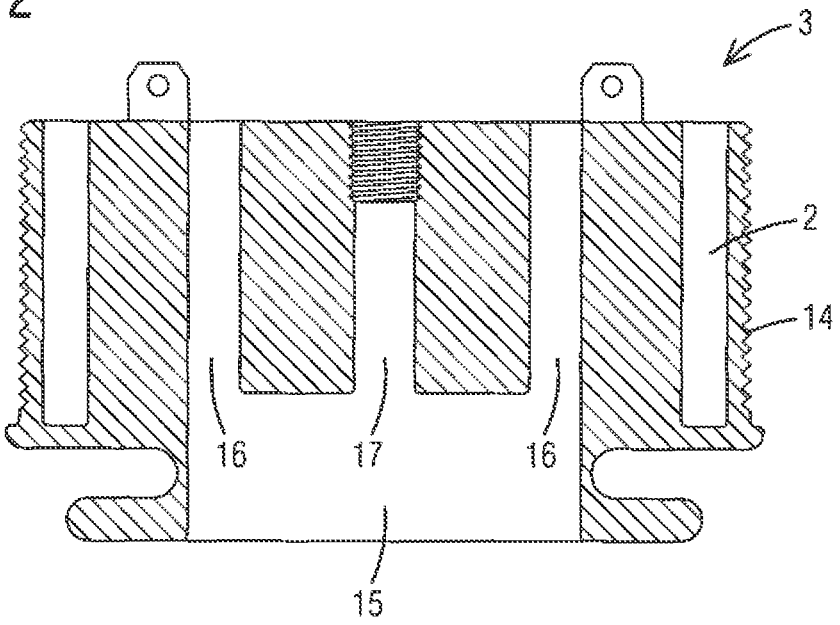
FIG. 2 is a side cross sectional view of the base portion of the shaving brush of the present invention.
Figure 3:
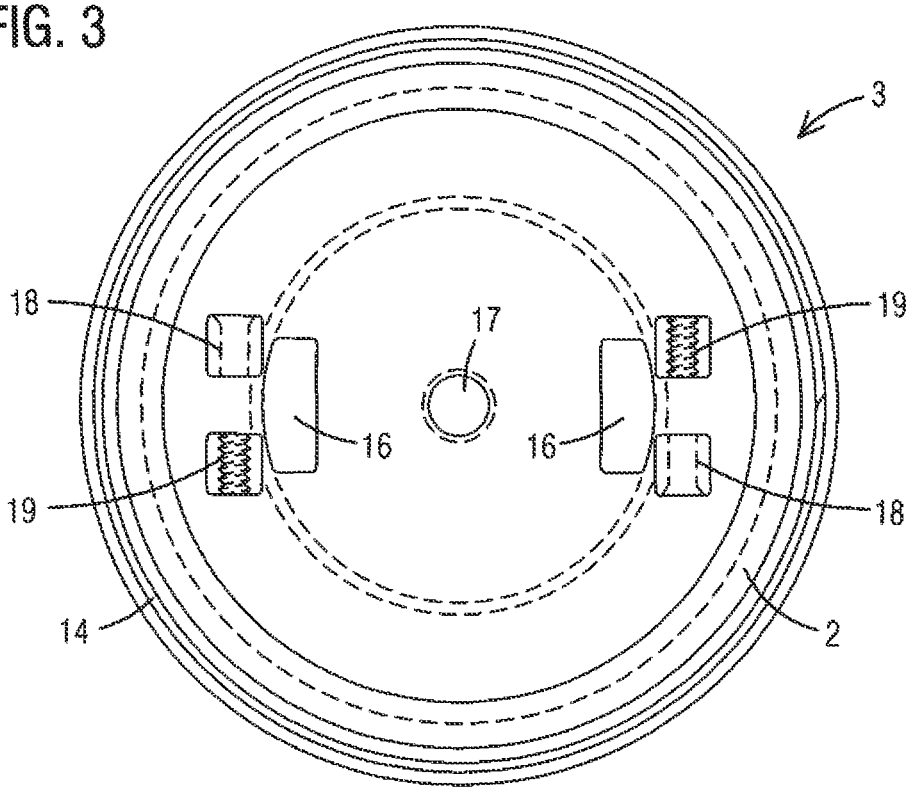
FIG. 3 is a top view of the base portion of the shaving brush of the present invention.

Referring now to FIGS. 2 and 3, which illustrate the base 3 only of the shaving brush, the threads 14 where the decorative outer ring 8 screws onto the base 3 is shown. The tension sleeve housing 2 without the tension sleeve 1 being stored in it is shown. A cavity 15 is the space where the release button 4, a cavity 16 for the push rods 7 and central cavity shaft 17 for the central spring 6 for when the shaving brush is assembled are shown. The central shaft 17 is threaded at the top for the purpose of adjustment of the pedestal 13, as shown in FIG. 1. Mounting anchors 18 & 19, from where the fastening cuffs 9 pivot, are shown. Only one anchor 19 on each side of the base 3 is threaded. The other anchor 18 is smooth.

Referring now to FIGS. 4, 5 and 6, which illustrate the front, side and bottom views, respectively, of the fastening cuffs 9 of the shaving bush device, the two fastening cuff guides 10 are shown, having fulcrum holes 20, where the fastening cuffs 9 are secured onto the base 3 by threaded screws 11, as shown in FIG. 1. A circular hole 21 is provided to allow space for the top portion of the pedestal 13 as shown in FIG. 1, so that there is no contact between the pedestal 13 and the fastening cuffs neck 22. Threading 23 on the outer portion of the fastening cuffs 9 articulate with the tension sleeve 1, when it is engaged, as shown in FIG. 1. A small lip 24 on the top of the fastening cuffs 9 holds the adaption hoop 12 in place, also as shown in FIG. 1. The interior space 25 of the fastening cuffs 9 preferably measures 32 millimeters, which is the outer diameter of every adaption hoop 12. This also indicates that the shaving brush by design can also fit a 32 millimeter shaving bristle knot, without the use of an adaption hoop 12.

Figure 7:
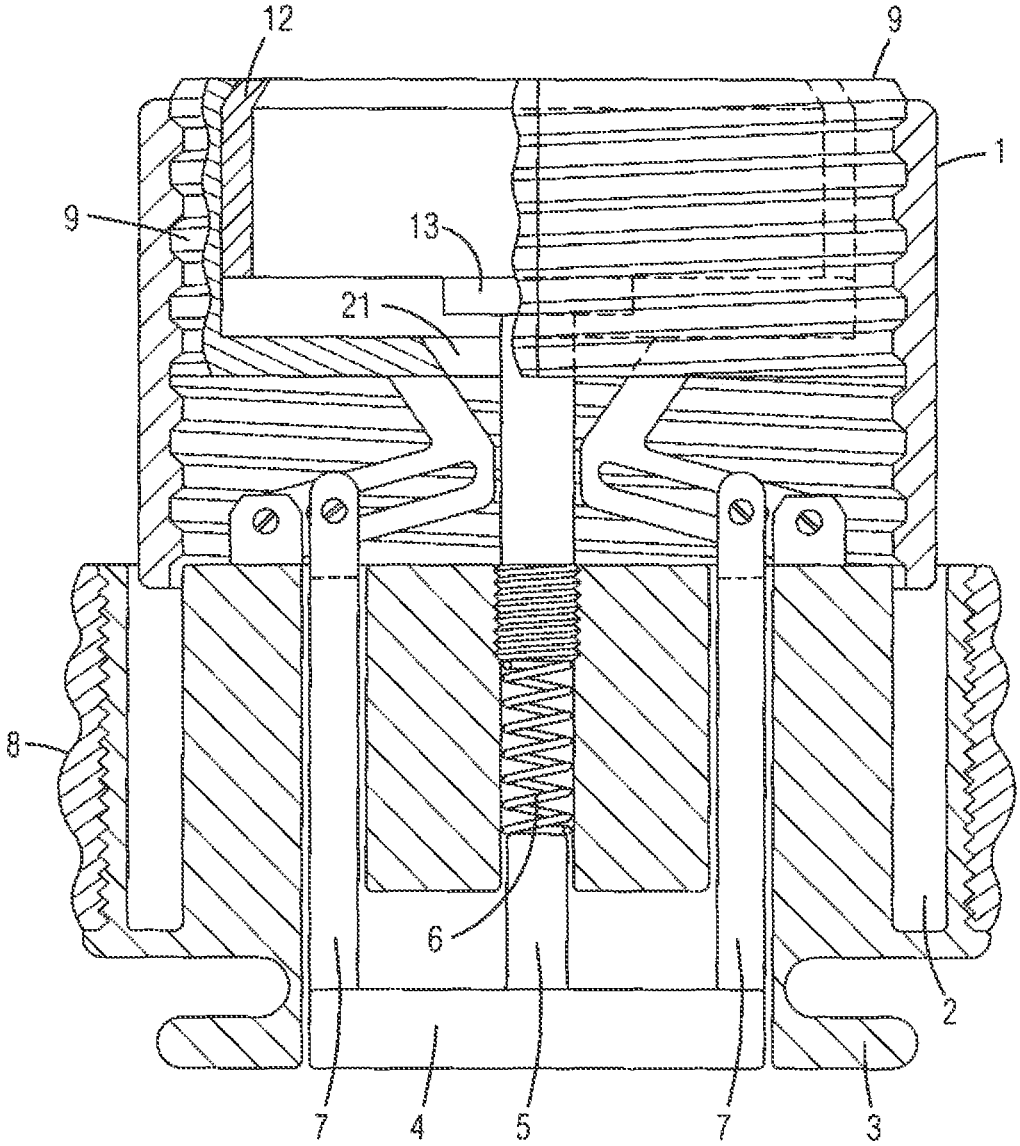
FIG. 7 is a front partial cut-away view of the shaving brush in a closed position, with the tension sleeve engaged on to the outside of the fastening cuffs, which clamp the adaption hoop that houses the shaving knot bristle.

Referring now to FIG. 7, a partial cut away view of the shaving brush, shows the tension sleeve 1, engaged around the two fastening cuffs 9, which secures the adaption hoops 12. In this view the tension sleeve housing 2 is empty, as the tension sleeve 1 itself is engaged. Also, the adaption hoop 12 has no shaving bristle knot.

Figure 8A:
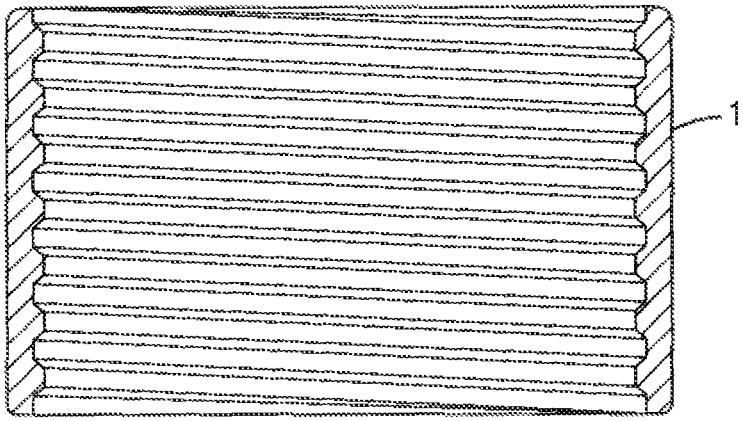
FIGS. 8*a* and 8*b* are side and top views, respectively, of the tension sleeve, which secures the fastening cuffs when engaged, which in turn, locks in the adaption hoop to the shaving brush of the present invention.
Figure 8B:
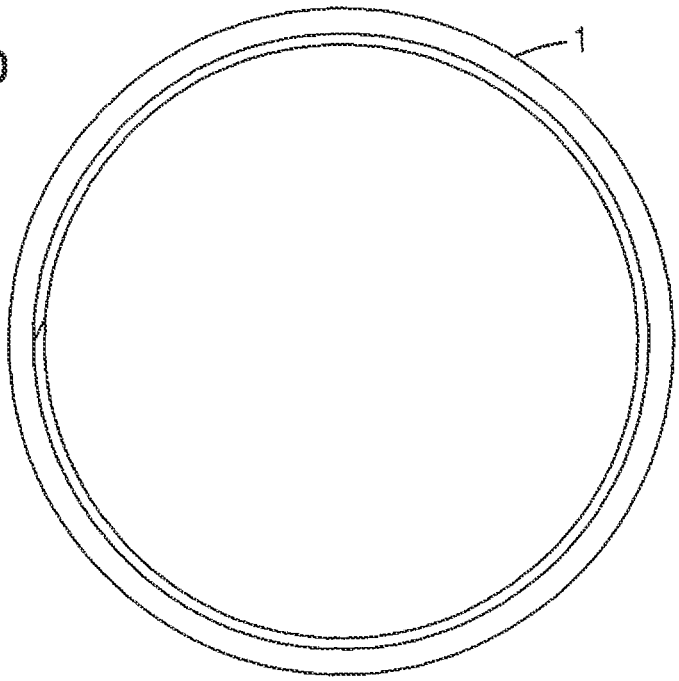

Referring now to FIGS. 8*a* and 8*b*, cut-away side and top views, respectively, show the tension sleeve 1, with detail of the wide pattern threading that articulates with the fastening cuffs 9, when engaged.

Figure 9A:
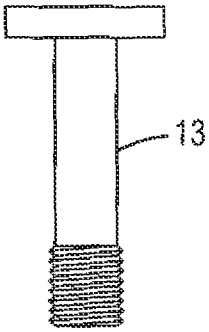
FIGS. 9*a* and 9*b* are side and top views, respectively, of the pedestal which supports the bristle knot from the bottom in the shaving brush of the present invention.
Figure 9B:
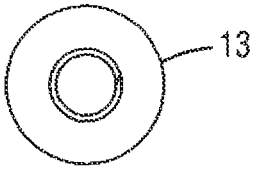

Referring now to FIGS. 9*a* and 9*b*, top and side views, respectively, of the pedestal 13, which supports the shaving bristle knot and adaption hoop 12 (see FIG. 1) are shown.

Figure 10A:
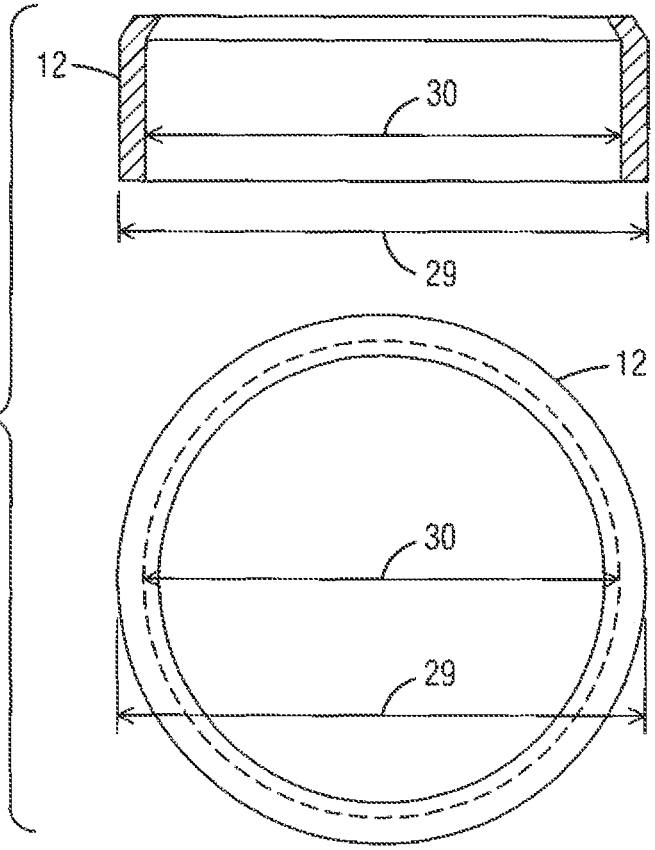
FIGS. 10*a* and 10*b* are top and side views, respectively, of the adaption hoops that can adapt any size shaving knot to the shaving brush, depending on the inside diameter of the adaption hoop, FIG. 10*a* showing an adaption hoop having a 30 millimeter inner diameter and FIG. 10*b* showing an adaption hoop having a 26 millimeter inner diameter.
Figure 10B:
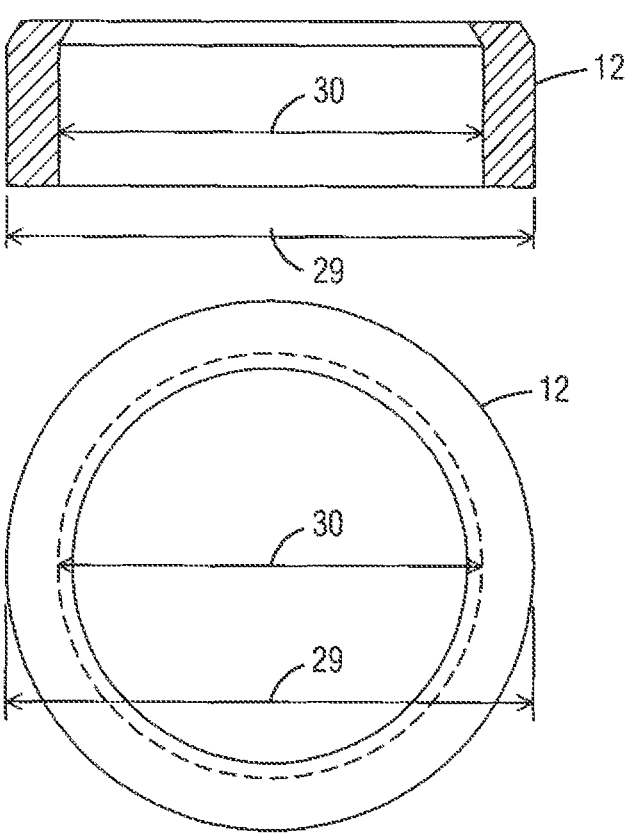
Figure 11:
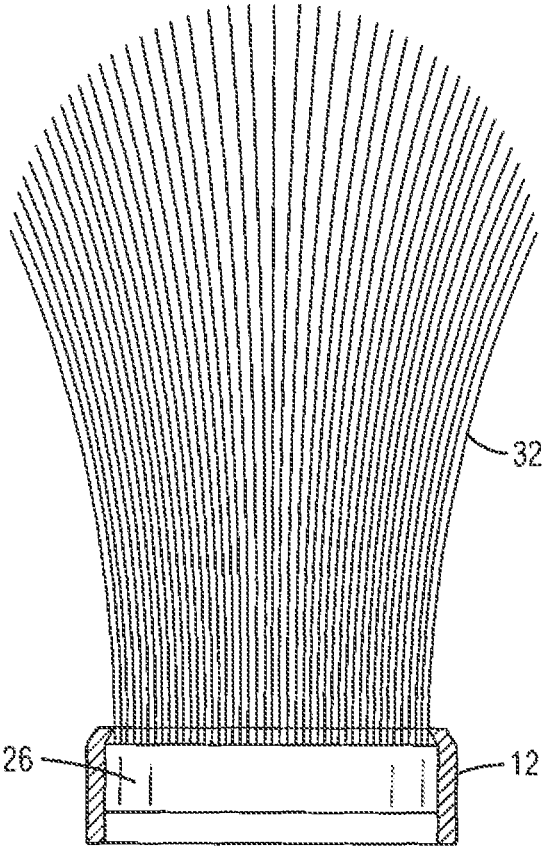
FIG. 11 is a cut-away side view of a shaving brush bristle knot secured within the adaption hoop of the shaving brush of the present invention.

Referring now to the drawings in FIG. 10*a* an adaption hoop 12 having an inner diameter 30 of 30 millimeters is shown. The outer diameter 29 of the adaption hoop 12 is 32 millimeters, the same for every adaption hoop 12. However, in the drawings of FIG. 10*b*, the inner diameter 30 of the adaption hoop 12 is sized fora 26 millimeter shaving brush bristle knot. Although 26 and 30 millimeters may be common sizes for shaving brush bristle knots, the inner diameters of the hoop 12 may be made of any size to fit any shaving brush bristle knot 26 as desired so long as it fits securely within the hoop 12 as illustrated in FIG. 11.

Figure 12:
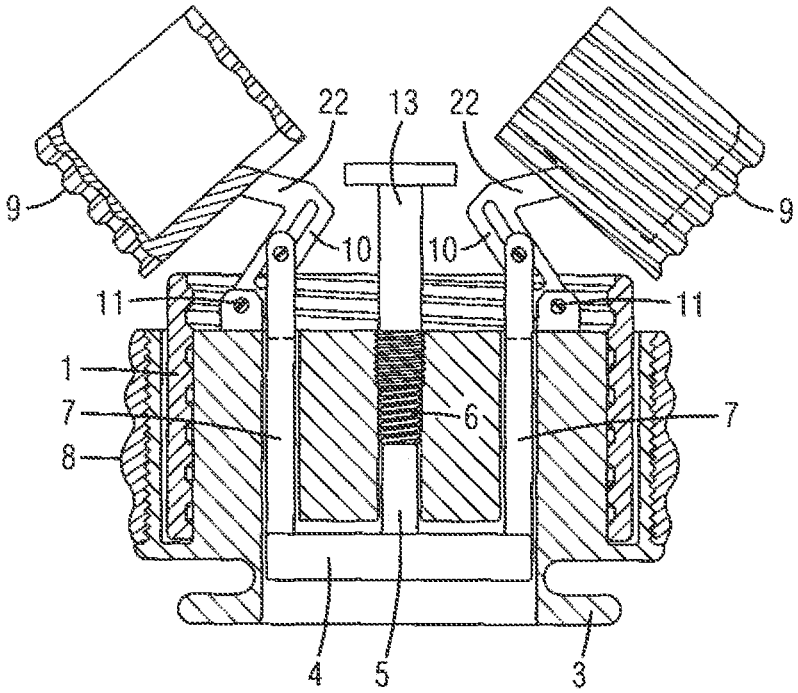
FIG. 12 is a partial cut-away view of the shaving brush of the present invention in an open position ready to receive the shaving bristle knot that has been fitted with an adaption hoop.

Referring now to FIG. 12 the shaving brush is shown in the open position by way of pushing the release button 4, which acts against the force of the central spring 6, via the central resistance rod 5, which causes the lifting of the fastening cuff necks 22, by way of the push rods 7, sliding inside the fastening cuff guides 10. The fastening cuff guides 10 are located at the base of the fastening cuff necks 22, and pivot at the fulcrum 11, located at the top portion of the base.

Figure 13A:
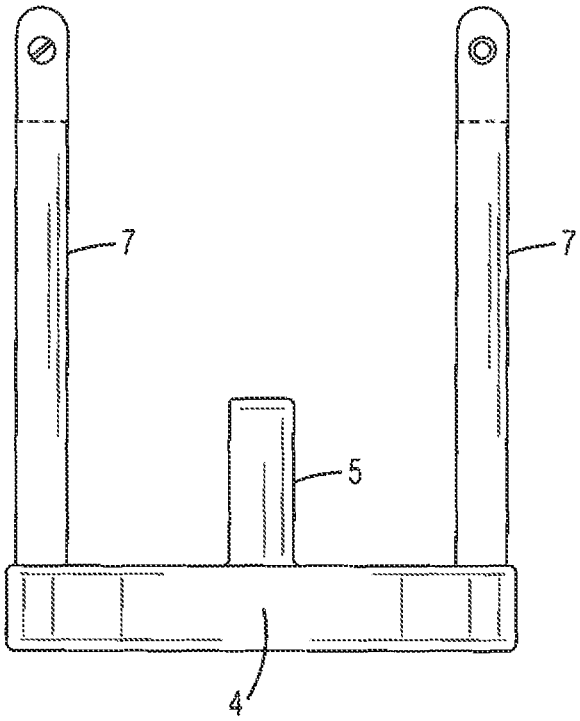
FIGS. 13*a*, 13*b*, and 13*c* are front, side and top views, respectively, of the push button release located in the bottom of the shaving brush which activates the fastening cuffs to open when desired via push rods.
Figure 13B:
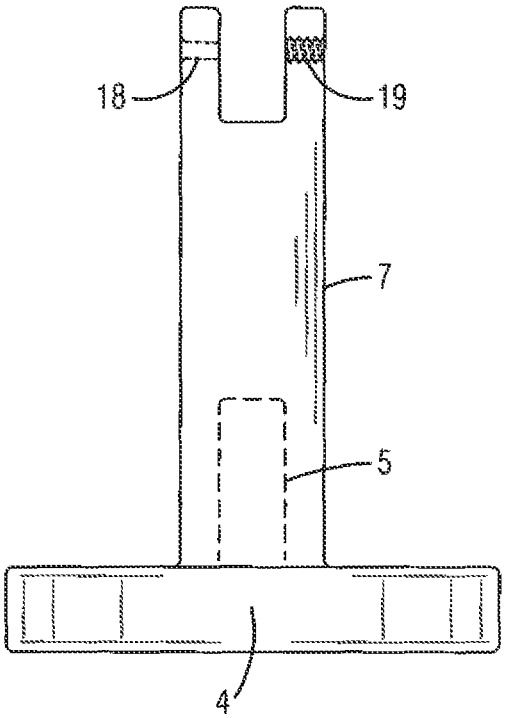
Figure 13C:
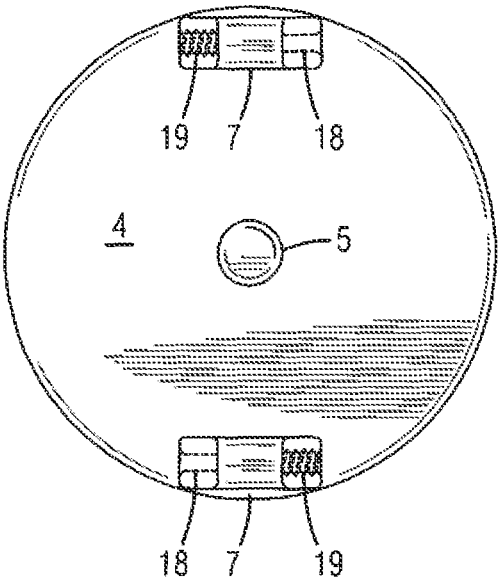

Referring now to FIGS. 13*a*, 13*b* and 13*c* the details of the release button 4 located inside the base stand 3 are shown. There are three components to the release button 4, the two push rods 7 that move up and down through the body of the shaving brush articulating with the fastening cuff guides 10, with a screw 27 that is passed through each side and through the fastening cuff guides 10, one screw for each of the push rods 7. The release button 4 is pushed at the base 3 of the shaving brush. Resistance is felt from the central spring 6 that pushes on the central resistance rod 5 which will always return the tele m button 4 flush with the bottom of the base stand 3, as the distance outward that the release button 4 can travel is governed by the specific length of the push rods 7.

Figure 14A:
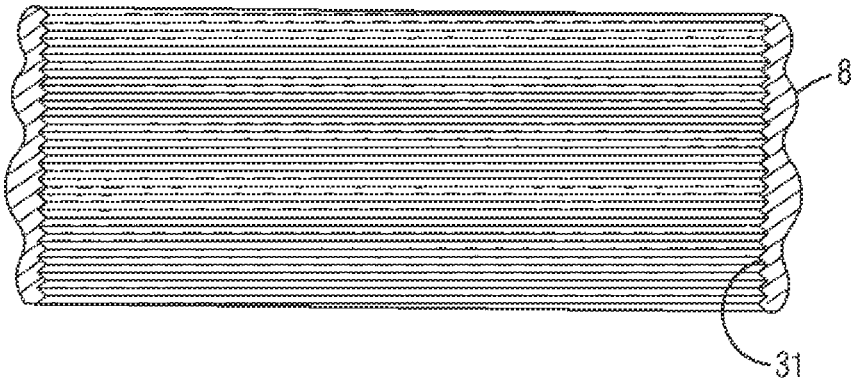
FIGS. 14*a* and 14*b* are cut-away side and top views, respectively, of the outer decorative ring of the shaving brush of the present invention.
Figure 14B:
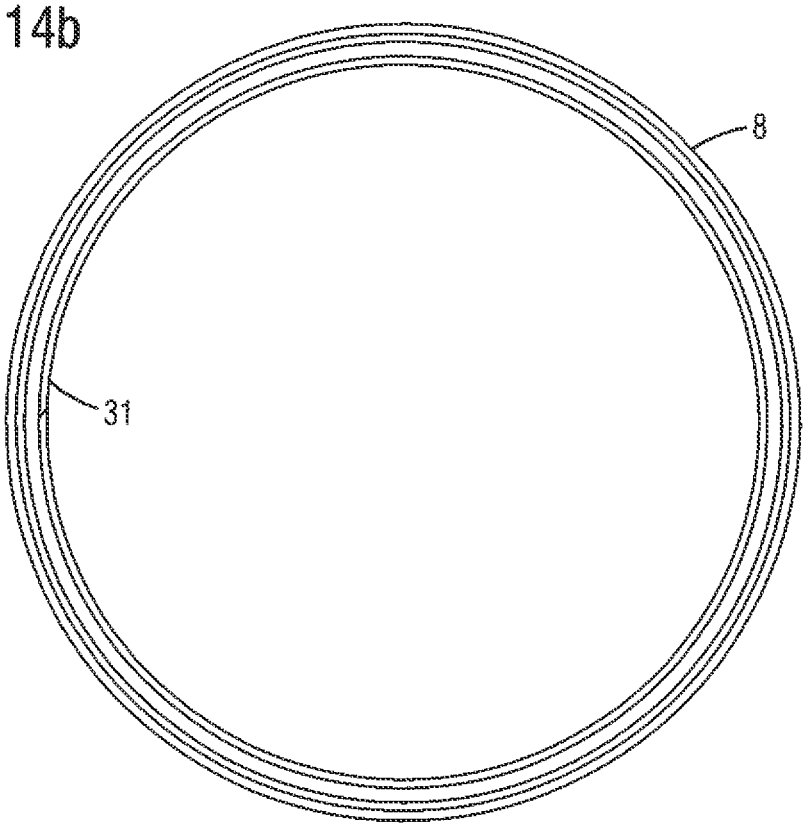

Referring now to FIGS. 14*a* and 14*b*, cut-away side and top views, respectively, show the decorative outer ring 8 and inside threading 31. The outer ring 8 preferably has a simple wave shape. This is just an example, and by no means limited as to how the outer decorative ring could be designed as, nor does it restrict the material of which the decorative outer ring could be made.

Figure 15:
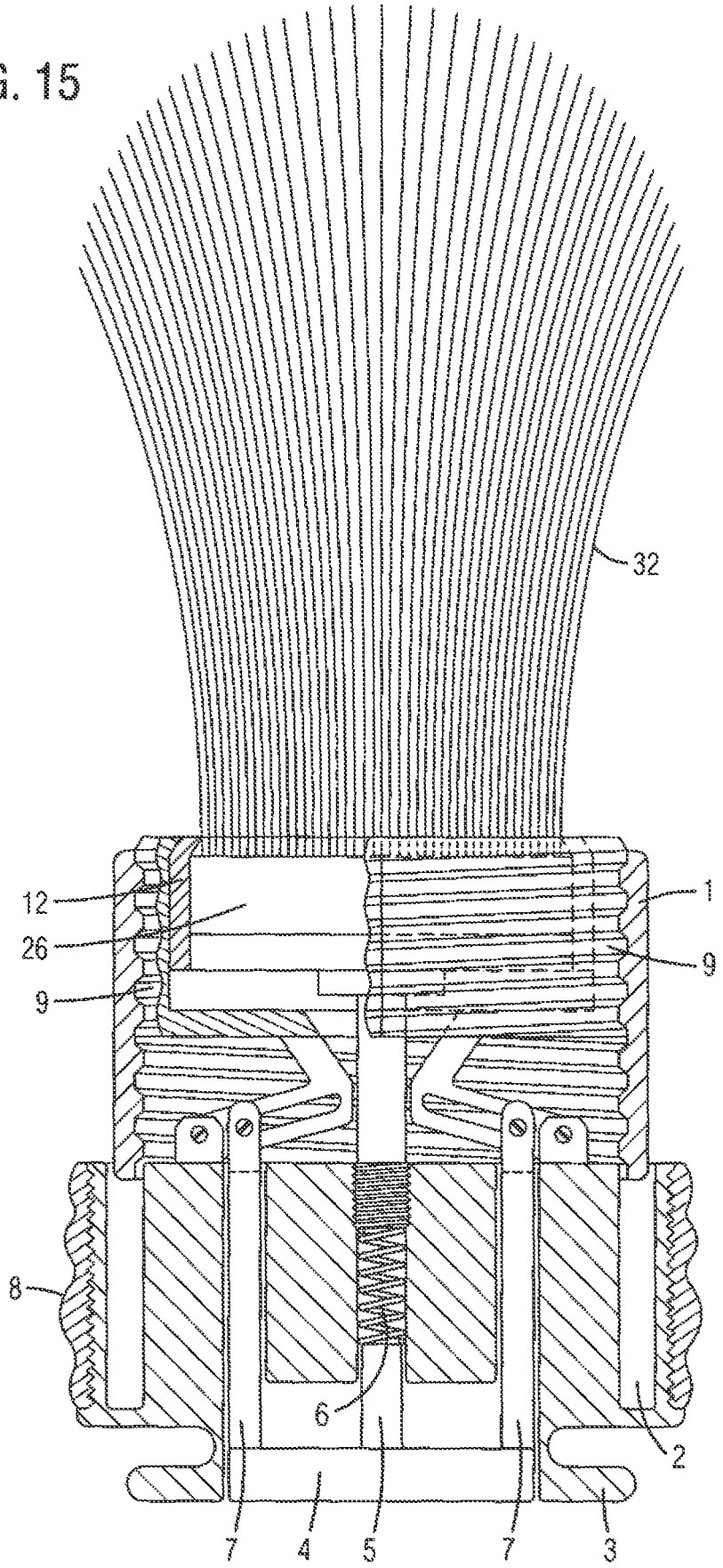
FIG. 15 is a partial cut-away front view of the entire brush with an adaption hoop fitted with a bristle knot.

Referring now to FIG. 15, a full view of the shaving brush and bristle 32 of the present invention is illustrated in partial cut-away so that the internal components are shown. The tension sleeve 1 can be seen here engaged and locking the fastening cuffs 9, in place which is fitted with a 30 millimeter adaption hoop 12, which has a bristle shave knot 26 fitted within.

Figure 16:
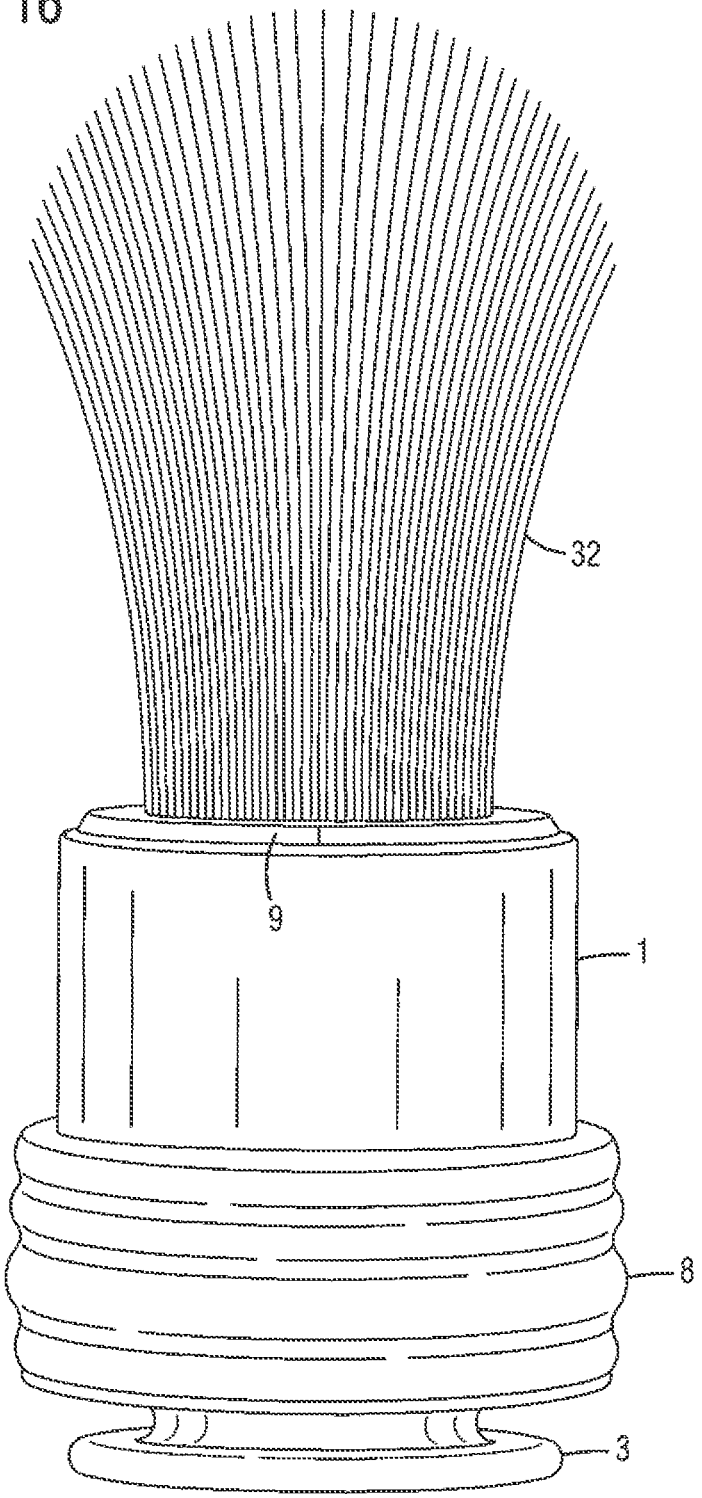
FIG. 16 is a front perspective view of shaving brush of the present invention ready for use with a shaving knot bristle that has been fitted without the use of glue.

Referring to the final drawing figure, FIG. 16 is a perspective view of the fully assembled shaving brush of the present invention showing the previously-identified outer components.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A shaving brush with interchangeable bristles comprising:

a base supporting a housing;

said housing having a sleeve for securely holding fastening cuffs;

said fastening cuffs being connected to the base by a fulcrum which is connected to a spring button on the base;

retractable guides mounted on a top of the housing for retaining the fastening cuffs;

at least one push rod connected to the spring button which extend to the retractable guides to retain the fastening cuffs in an open position when the spring button is activated or a closed position when the fastening cuffs are in the housing; and an adaption hoop inside the fastening cuffs, said adaption hoop resting on a pedestal and being sized to fit and retain a shaving brush bristle knot.

2. The shaving brush of claim 1 further comprising a ring on the outside of the housing for gripping the shaving brush by a user.

3. The shaving brush of claim 1 wherein the adaption hoop has a top lip for better retention of the shaving brush bristle knot.

4. The shaving brush of claim 1 wherein the spring button has a rod on a top to engage and retain the pedestal when the fastening cuffs are in the closed position in the housing.

5. The shaving brush of claim 1 wherein an inner diameter of the adaption hoop is 30 millimeters.

* * * * *